US009997302B2

(12) United States Patent
Danov et al.

(10) Patent No.: US 9,997,302 B2
(45) Date of Patent: Jun. 12, 2018

(54) ELECTRICAL COMPONENT HAVING AN ELECTRICALLY CONDUCTIVE CENTRAL ELEMENT

(71) Applicant: Siemens Aktiengesellschaft, Munich (DE)

(72) Inventors: Vladimir Danov, Erlangen (DE); Stefan Kern, Frankfurt am Main (DE); Jochen Schaefer, Nuremberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days. days.

(21) Appl. No.: 15/324,895

(22) PCT Filed: Jun. 25, 2015

(86) PCT No.: PCT/EP2015/064408
§ 371 (c)(1),
(2) Date: Jan. 9, 2017

(87) PCT Pub. No.: WO2016/005197
PCT Pub. Date: Jan. 14, 2016

(65) Prior Publication Data

US 2017/0207036 A1 Jul. 20, 2017

(30) Foreign Application Priority Data

Jul. 7, 2014 (DE) ..... 10 2014 213 100

(51) Int. Cl.
*H01H 1/62* (2006.01)

(52) U.S. Cl.
CPC ..... *H01H 1/62* (2013.01)

(58) Field of Classification Search
CPC ..... H01H 1/62; H01H 9/30; H01H 33/662; H01H 2033/66276; H01H 2033/6613
(Continued)

(56) References Cited

U.S. PATENT DOCUMENTS 3,129,308 A * 4/1964 Yokoyama ..... H01H 33/66238 200/288
3,973,096 A * 8/1976 Burgoon ..... H01H 9/52 200/289
(Continued)

FOREIGN PATENT DOCUMENTS

DE 2238987 A1 2/1974 ..... F28D 15/04
EP 1672655 A1 6/2006 ..... H01H 1/62
(Continued)

OTHER PUBLICATIONS

German Office Action, Application No. 102014213100.6, 7 pages, dated May 11, 2015.
(Continued)

*Primary Examiner* — Renee Luebke
*Assistant Examiner* — William Bolton
(74) *Attorney, Agent, or Firm* — Slayden Grubert Beard PLLC

(57) ABSTRACT

An electrical component may include an electrically conductive element and electrical insulation that at least partially surrounds the element and without contact. A heat pipe may be surrounded by the insulation at least at one end and may partially protrude from the insulation, wherein the part of the heat pipe protruding from the insulation protrudes closer to the central element than the insulation.

9 Claims, 2 Drawing Sheets

(58) Field of Classification Search
USPC ..... 218/158, 155, 150, 134, 136; 361/115
See application file for complete search history.

(56) References Cited

U.S. PATENT DOCUMENTS

| | | | | |
|---|---|---|---|---|
| 4,005,297 | A * | 1/1977 | Cleaveland | F28D 15/02 165/104.26 |
| 4,650,939 | A * | 3/1987 | Milianowicz | H01H 1/62 200/289 |
| 4,937,405 | A * | 6/1990 | Pilsinger | H01H 33/66261 218/121 |
| 7,471,495 | B2 | 12/2008 | Steffens et al. | 361/115 |
| 7,852,617 | B2 * | 12/2010 | Lee | H01H 33/6606 361/676 |
| 8,278,582 | B2 * | 10/2012 | Tu | H01H 9/52 218/118 |
| 2009/0255794 | A1 | 10/2009 | Kurth et al. | 200/289 |

FOREIGN PATENT DOCUMENTS

| | | | | |
|---|---|---|---|---|
| WO | 2016/005197 | A1 | 1/1916 | H01H 33/66 |
| WO | 2006/092380 | A1 | 9/2006 | H01H 33/66 |

OTHER PUBLICATIONS

International Search Report and Written Opinion, Application No. PCT/EP2015/064408, 20 pages, dated Oct. 1, 2015.

* cited by examiner

ELECTRICAL COMPONENT HAVING AN ELECTRICALLY CONDUCTIVE CENTRAL ELEMENT

CROSS-REFERENCE TO RELATED APPLICATIONS

This application is a U.S. National Stage Application of International Application No. PCT/EP2015/064408 filed Jun. 25, 2015, which designates the United States of America, and claims priority to DE Application No. 10 2014 213 100.6 filed Jul. 7, 2014, the contents of which are hereby incorporated by reference in their entirety.

TECHNICAL FIELD

The invention relates to an electrical element comprising an electrically conductive central element.

BACKGROUND

Electrical elements through which high current intensities run when said electrical elements are used as intended, for example interrupters, medium-voltage switchgear installations or high-voltage interrupters, have to be electrically insulated from their surroundings. Current-carrying components of this kind are subject to industry standards which define a permissible limit temperature. In order to be able to transmit as high a current as possible without reaching the limit temperatures, attempts are made firstly to reduce the development of heat owing to electrical resistances which are as low as possible and secondly to discharge the produced heat to the surroundings by convection and/or radiation. By way of example, several measures for reducing the temperature were implemented in the case of medium-voltage switchgear installations according to the prior art, said measures firstly involving the line cross section itself, the screw connection, the resistances across the interrupters and disconnector switches and also the installation of cooling plates. Furthermore, the surface area of containers was increased and the flow in the container was optimized by simulation. The thermal radiation properties of the current-carrying elements were improved, for example, by coating. All of these measures have led to an improvement in the propagation of heat in the electrical components, but the insulators, which are generally formed from cast plastics with thermal and electrical properties which are adapted in a targeted manner, are nevertheless subject to high thermal loads. In this case, there is always a conflict of objectives between the electrical conductivity and the thermal conductivity when producing and constructing a suitable insulation material for insulating said elements. This is because good electrical conductors are generally also good thermal conductors and vice versa, and good thermal insulators are generally also good electrical insulators. However, in the case of the insulation materials which are to be constructed, the aim is to achieve the best possible thermal conduction in addition to good electrical insulation.

SUMMARY

One embodiment provides an electrical component comprising an electrically conductive central element and an electrical insulation which surrounds said element at least partially without contact, wherein a thermal tube is provided, which thermal tube is surrounded by the insulation at least at one end and partially protrudes out of the insulation, wherein a part of the thermal tube which protrudes out of the insulation protrudes closer to the central element than the insulation.

In one embodiment, the thermal tube is integrated in the insulation in an interlocking and/or cohesive manner.

In one embodiment, the thermal tube is cast into the insulation.

In one embodiment, the electrical element is an interrupter.

In one embodiment, the insulation concentrically surrounds the central element.

In one embodiment, the thermal tube runs concentrically inward from the insulation.

In one embodiment, one end of the thermal tube is recessed in the insulation by at least 30% of a wall thickness of said insulation.

In one embodiment, a plurality of thermal tubes are uniformly distributed around the central element.

In one embodiment, the central element is a switching contact of the interrupter.

BRIEF DESCRIPTION OF THE DRAWINGS

Example aspects and embodiment of the invention are explained in greater detail below with reference to the figures, in which.

DETAILED DESCRIPTION

Figure 1:
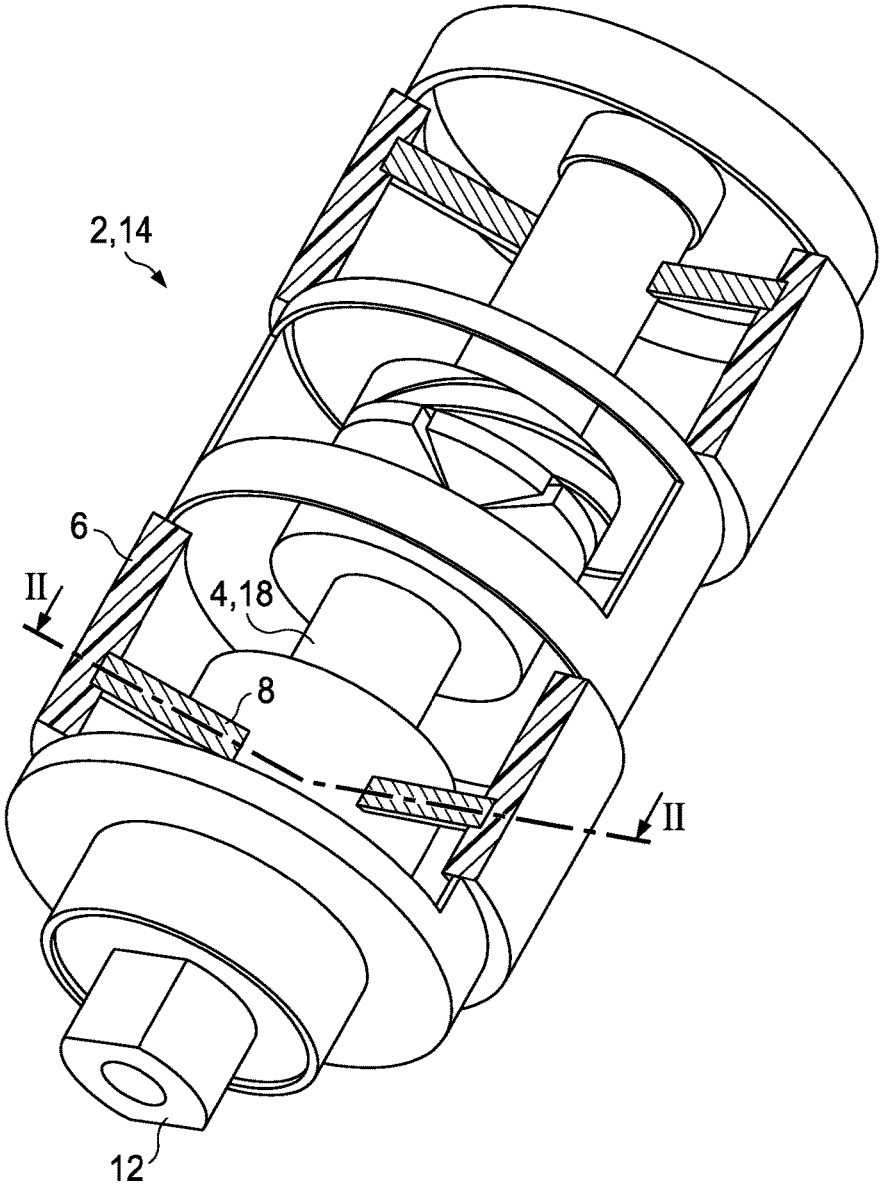
FIG. 1 shows a three-dimensional sectional illustration of an example medium-voltage interrupter comprising an insulation and thermal tubes, according to one embodiment of the invention.

Embodiments of the invention provide an electrical component comprising an electrically conductive central element and an electrical insulation which surrounds said element, said electrical component allowing improved heat dissipation of the thermal energy given off from the central element in comparison to the prior art.

Some embodiments provide an electrical component comprising an electrically conductive central element and an electrical insulation which surrounds said element at least partially without contact as disclosed herein.

The component may comprise an electrically conductive central element having at least one electrical insulation which partially surrounds the central element, and is distinguished in that a thermal tube is provided, which thermal tube is surrounded by the insulation at least at one end and partially protrudes out of the insulation. In this case, that part of the thermal tube which protrudes out of the insulation protrudes closer to the central element than the insulation.

In this case, a thermal tube is intended to be understood to mean a heat exchanger which, utilizing the heat of evaporation of a medium, in particular of a fluid, permits a high thermal flux density. That is to say that large amounts of heat can be transported via a small cross-sectional area. A distinction can be made between two types of thermal tube, specifically the heat pipe and the two-phase thermosiphon. The fundamental functional principle is the same for both types, wherein the difference is in the transportation of the working medium, that is to say of the fluid, which, however, generally manages without additional mechanical aids, such as a recirculation pump for example. The thermal resistance of a thermal tube is considerably lower than that of metals. Therefore, the behavior of the thermal tubes is similar to that of the isothermal change in state. An almost constant temperature prevails over the length of the thermal tube. That is to say, it is possible to transmit a specific thermal current with a considerably lower temperature gradient than in the case of a metal. For comparison, the thermal conductivity of copper is approximately 360 W/mK and the effective thermal conductivity of a thermosiphon or a heat pipe (thermal tube) is ~10000 W/mK. As already described above, a thermosiphon does not destroy any heat, but rather serves only to transfer heat. In the case of the encapsulation compound, the problem is not the dissipation of heat but rather the transfer of heat along the component. Therefore, the influence of a thermosiphon or thermal tube is considerable. Given the same transfer performance, substantially simpler designs than in the case of conventional heat exchangers are therefore possible under the same use conditions. The thermal tube can, in principle, have a metallic sheathing or else an electrically insulating sheathing, such as glass or ceramic for example.

A component which simultaneously forms the housing of a thermosiphon or heat pipe is expedient. Contact resistances are avoided in this way. The pressure and the use temperature play an important role here. Possible fluids for this would be, for example, Novec 649 (at 105° C. approximately 5 bar), Novec 774 (at 105° C. approximately 2.5 bar) etc.

An advantage of embodiments of the invention is that the heat which the central element, which is electrically conductive and through which electric currents flow in an operating state, is carried away from this central element more quickly. Furthermore, the heat is also inserted deeper into the material of the insulation by the thermal tube since one end of the thermal tube is surrounded by the insulation, so that this end of the thermal tube protrudes into the insulation. Therefore, the path which the heat which is transferred into the insulation by the thermal tube has to cover until it reaches the outside of the insulation is shorter than when it has to reach an inside of the insulation by convection and be dissipated through the entire insulation by means of thermal conduction processes. The thermal stress to which the insulation is subjected is reduced by the described measures, this likewise reducing production costs for the insulation.

According to one embodiment, the thermal tube is integrated in the insulation in an interlocking and/or cohesive manner. The interlocking or cohesive fit of the thermal tube in the insulation ensures good heat transfer. In this case, the thermal tube can be fastened in the insulation by a press-fit, but it may be advantageously cast into the insulation component to be formed directly during production of the insulation in a so-called encapsulation compound.

In one embodiment, the electrical element is an interrupter, for example a medium-voltage interrupter, and the central element is an associated switching contact. In the case of medium-voltage interrupters in particular, particularly large amounts of heat occur at the switching contacts and have to be dissipated out of the interrupter to the outside.

In this case, the insulation, e.g., concentrically, surrounds the central element, wherein the one or more thermal tubes also runs or run concentrically inward from the insulation, wherein the thermal tubes preferably run uniformly around the central element radially toward the outside into the insulation. This ensures uniform heat transfer into the insulation.

In this case, it is likewise expedient that one end of the thermal tube, which is surrounded by the insulation, protrudes at least 30% into the wall thickness of the insulation, that is to say is recessed in the insulation at least by 30% of the wall thickness of said insulation.

FIG. 1 shows a three-dimensional sectional illustration of an electrical element 2 in the form of an interrupter 14. The interrupter 14 has a central element 4 in the form of a switching contact 18 in the central region. In this case, the switching contact 18 is surrounded by an electrical insulation 6. Thermal tubes 8 which run inward from the electrical insulation 6 centrally to the switching contact 18 are provided.

Figure 2:
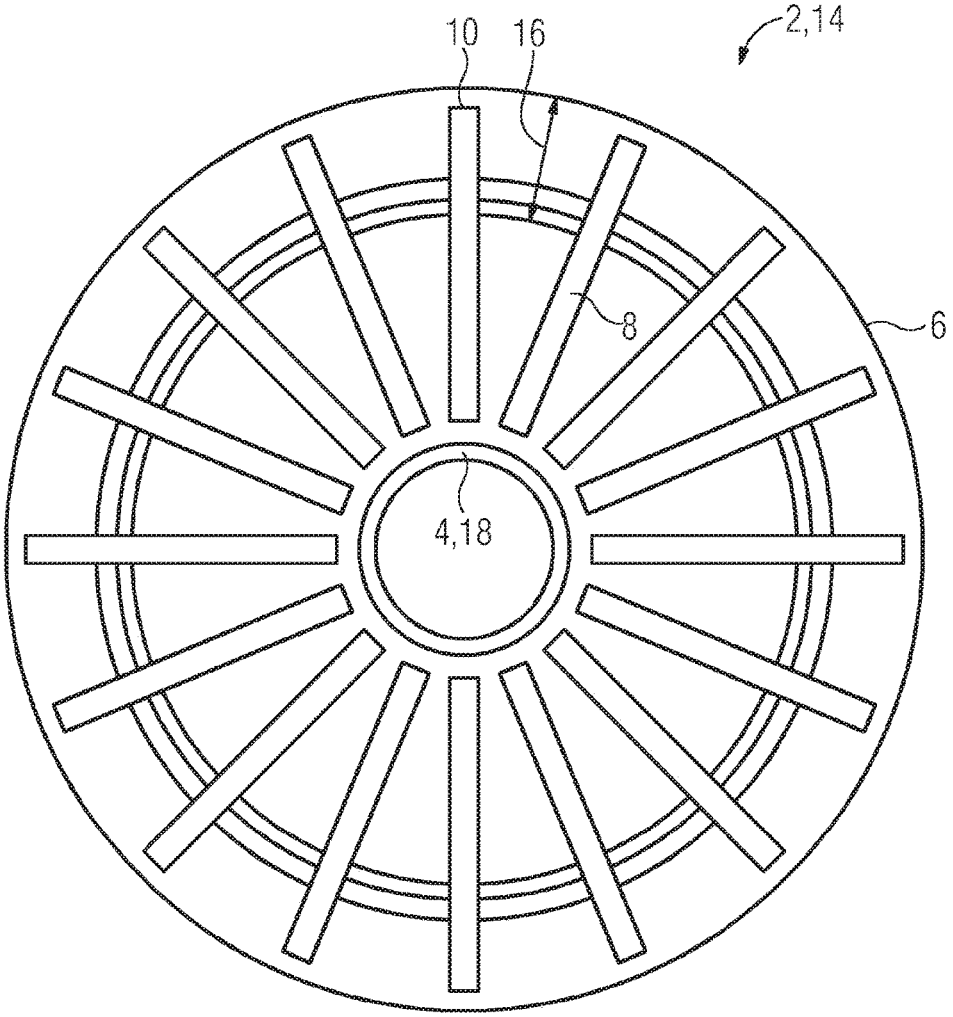
FIG. 2 shows a section through an interrupter according to FIG. 1 along line II.

FIG. 2 shows a section, not illustrated true to scale, along the dashed line II in FIG. 1, wherein it can be seen that a plurality of thermal tubes 8 point from the insulation 6 concentrically inward in the direction of the switching contact 18, wherein said thermal tubes do not make contact with said switching contact. The thermal tubes 8 are arranged such that they do not make contact with the switching contact 18 for reasons of electrical safety. However, said thermal tubes come close to the switching contact 18 to the extent that this is acceptable in respect of the insulation which is to be ensured. The thermal tubes 8 transfer the heat emitted by the switching contact 18, as already described, more quickly than a normal metallic thermal conductor and therefore also more quickly than would be the case by pure thermal radiation or convection in the direction of the insulation 6.

The insulation 6 is a plastic which is specially designed for electrical insulation and thermal stability and may be cast and also can be referred to as a so-called encapsulation compound, wherein the thermal tubes 8 are already cast into said encapsulation compound during production of the insulation 6. It goes without saying that it is also possible, in principle, to make holes in the insulation and then to integrate the thermal tubes 8 into the insulation 6 in particular in the form of a press-fit. In this case, the thermal tubes 8 protrude into a wall thickness 16 of the insulation 6 to a considerable extent. There are two limiting factors to this, firstly the thermal tubes 8 should protrude as far as possible into the wall of the insulation 6 so that the heat which is transferred by the thermal tubes 8 is carried as far as possible to the outside with respect to the interrupter and only a short path has to be covered by the conventional thermal conduction. Secondly, it is necessary to take into account that the electrical insulation properties of the insulation 6 are reduced at the points at which the thermal tubes 8 protrude into the insulation. The aim of this is that the thermal tubes 8 protrude into the insulation, at least by 30% of the wall thickness of said insulation, by way of their end which is recessed in the insulation 6.

In order to increase the electrical insulation in the region of the thermal tube 8 too, it is expedient that the thermal tube 8 is formed from an electrically non-conductive casing material. Furthermore, the fluid which is located in the thermal tube can also be electrically insulating, it being possible to use, for example, desalinated water or fluids such as NOVEC 649, NOVEC 7000 and FC 72 for this purpose. In this case, the fluid is located in a closed area of the thermal tube 8. The fluid is always in thermodynamic equilibrium. If the temperature is increased, in this case at a protruding end 12 of the thermal tube 8 which is arranged adjacent to the switching contact 18, the fluid begins to boil on this hot side. The steam which is produced in the process is transported to the colder side at the end 10 of the thermal tube 8. The fluid condenses there and releases the heat again. The fluid can be transported on the basis of capillary forces prevailing in the thermal tube 8.

What is claimed is:

1. An electrical component comprising:

an electrically conductive central element, an electrical insulation disposed surrounding the central element at least partially without contacting the central element, and a thermal tube embedded in the insulation at least at one end and protruding from the insulation toward the central element without contacting the central element, conducting heat from the central element to the electrical insulation.

2. The electrical element of claim 1, wherein the thermal tube is integrated in the insulation in at least one of an interlocking manner or a cohesive manner.

3. The electrical element of claim 1, wherein the thermal tube is cast into the insulation.

4. The electrical element of claim 1, wherein the electrical element is an interrupter.

5. The electrical element of claim 1, wherein the insulation surrounds the central element concentrically.

6. The electrical element of claim 5, wherein the thermal tube runs concentrically inward from the insulation.

7. The electrical element of claim 1, wherein one end of the thermal tube is recessed in the insulation by at least 30% of a wall thickness of said insulation.

8. The electrical element of claim 1, wherein a plurality of thermal tubes are uniformly distributed around the central element.

9. The electrical element of claim 1, wherein the central element is a switching contact of the interrupter.

* * * * *